United States Patent [19]

Laird

[11] Patent Number: 5,000,512

[45] Date of Patent: Mar. 19, 1991

[54] UPHOLSTERED SEATING UNITS

[76] Inventor: William B. Laird, 370 Lambeth Walk, York, Pa. 17403

[21] Appl. No.: 334,655

[22] Filed: Apr. 6, 1989

[51] Int. Cl.[5] ..... A47C 4/02

[52] U.S. Cl. ..... 297/440; 297/232; 297/444; 297/416; 297/422

[58] Field of Search ..... 297/412, 416, 422, 440, 297/443, 444, 452, 232

[56] References Cited

U.S. PATENT DOCUMENTS

| | | | |
|---|---|---|---|
| 2,466,204 | 4/1949 | Brown | 297/416 X |
| 2,793,685 | 5/1957 | Spitz . | |
| 3,036,864 | 5/1962 | Arai | 297/440 X |
| 3,183,036 | 5/1965 | Hill . | |
| 3,380,777 | 4/1968 | Bennett . | |
| 3,563,599 | 2/1971 | Heumann . | |
| 3,564,700 | 2/1971 | Binek . | |
| 3,608,959 | 9/1971 | Sarvas | 297/440 X |
| 3,632,150 | 1/1972 | Milakovich . | |
| 3,700,282 | 10/1972 | Rowland . | |
| 3,704,911 | 12/1972 | Milakovich . | |
| 3,759,571 | 9/1973 | Korch . | |
| 3,857,120 | 12/1974 | Acker . | |
| 3,929,375 | 12/1975 | Gans . | |
| 3,973,800 | 8/1976 | Kogan . | |
| 4,077,517 | 3/1978 | Hilemn . | |
| 4,077,666 | 3/1978 | Heumann . | |
| 4,188,066 | 2/1980 | Terenzoni | 297/422 X |
| 4,225,179 | 9/1980 | Oltrona Visconti . | |
| 4,305,616 | 12/1981 | Martinez . | |
| 4,343,509 | 8/1982 | Lundgren . | |
| 4,395,071 | 7/1983 | Laird | 297/440 |
| 4,437,704 | 3/1984 | Hovsepians . | |
| 4,456,299 | 6/1984 | Steinmetz . | |
| 4,488,755 | 12/1984 | Nemschoff | 297/444 X |
| 4,492,409 | 1/1985 | Laird . | |
| 4,523,787 | 6/1985 | Robinson . | |
| 4,561,137 | 12/1985 | Smitherman et al. . | |
| 4,621,381 | 11/1986 | Schramek | 297/440 X |
| 4,651,363 | 3/1987 | Mizelle . | |

FOREIGN PATENT DOCUMENTS

| | | | |
|---|---|---|---|
| 1532516 | 6/1968 | France | 297/440 |
| 718374 | 10/1966 | Italy | 297/440 |

*Primary Examiner*—Peter R. Brown

*Attorney, Agent, or Firm*—Panitch Schwarze, Jacobs & Nadel

[57] ABSTRACT

Upholstered seating units include a frame, a plurality of removable, reversible, upholstered members including at least one back cushion, one seat cushion and one or more panels, and a plurality of support members which extend from the frame and which slidingly receive and are at least partially received in each of the upholstered members. The upholstered seat and back cushions include internal, biased movable latch members which automatically engage their support members. The upholstered panels may include a front panel, a rear panel, a pair of side panels, or, preferably all such panels. The upholstered panels either are provided with an internal, biased movable latch member to automatically and removably secure those panels to the support members receiving them or lack such a latch. Latchless panels are positioned to be retained on a support member by interference with other, latched upholstered members whereby all upholstered members are removably secured to the frame.

10 Claims, 4 Drawing Sheets

UPHOLSTERED SEATING UNITS

FIELD OF THE INVENTION

The invention relates to furniture and, in particular, to upholstered seating units.

BACKGROUND OF THE INVENTION

A number of furniture designs have been proposed for seating units which have cushions removably secured to their frames for use in public areas, institutions, etc. Soil and damage to upholstery are major considerations with respect to such furniture pieces. Manufacturers of such furniture often limit, as much as possible, the use of upholstery in such furniture. However, fully upholstered furniture is desirable for a number of other reasons, including aesthetics.

A wide variety of upholstered seating units of knock-down type construction have been designed. Such units may be assembled for use and usually disassembled thereafter, if desired. The upholstered components of such units are thus often removable for cleaning or replacement. With the exception of their upholstered cushions, however, knock-down furniture designs typically lack easily removable mounting, reversibility or interchangeability of the upholstered pieces. They also typically lack a capability to secure the cushions of such units to their frames or to positively lock any of the upholstered pieces to the frame to prevent their disassembly by unauthorized personnel. The lack of these characteristics limits the usefulness of knockdown furniture in public and institutional settings.

SUMMARY OF THE INVENTION

In one aspect, the invention is an upholstered seating unit comprising: a frame; a plurality of upholstered members including at least a back cushion, a seat cushion and a panel; and a plurality of support members fixedly secured to the frame. Each support member extends from the frame for slidingly receiving one of the upholstered members and each of the upholstered members internally receiving at least part of one of the support members, the support members removably supporting the upholstered members on the frame. An internal, biased, movable latch is provided in each of the upholstered members. Structural means are provided on each support member for receiving the latch to automatically and removably lock the upholstered members to the frame through the support members.

In another aspect, the invention is an upholstered seating unit comprising: a frame; a plurality of upholstered members including at least a back cushion, a seat cushion and a panel; and a plurality of support members connected with the frame. Each of the support members extends from the frame for slidingly receiving one of the upholstered members and each of the upholstered members internally receiving at least part of one of the support members for removably supporting the upholstered members on the frame by the support members. An internal, biased, movable latch is provided in each of a subset of the plurality of upholstered members. Each of the remaining upholstered members of the plurality lacks a latch. Each support member receiving one of the subset of upholstered members is fixedly attached to the frame and has structural means for receiving the latch to automatically and removably lock the subset of upholstered members to the frame through the support members. The subset of locked, upholstered members interferes with movement of each of the remaining upholstered members on the support members receiving the remaining upholstered members for preventing the removal of the remaining upholstered members from the support members and the frame whereby all upholstered members of the seating unit are automatically and removably secured to the frame.

BRIEF DESCRIPTION OF THE DRAWINGS

The foregoing summary, as well as the following detailed description of a presently preferred embodiment of the invention, will be better understood when read in conjunction with the appended drawings. It is understood, however, that this invention is not limited to the precise ar illustrated. In the drawings.

DETAILED DESCRIPTION OF THE PREFERRED EMBODIMENTS

Figure 1:
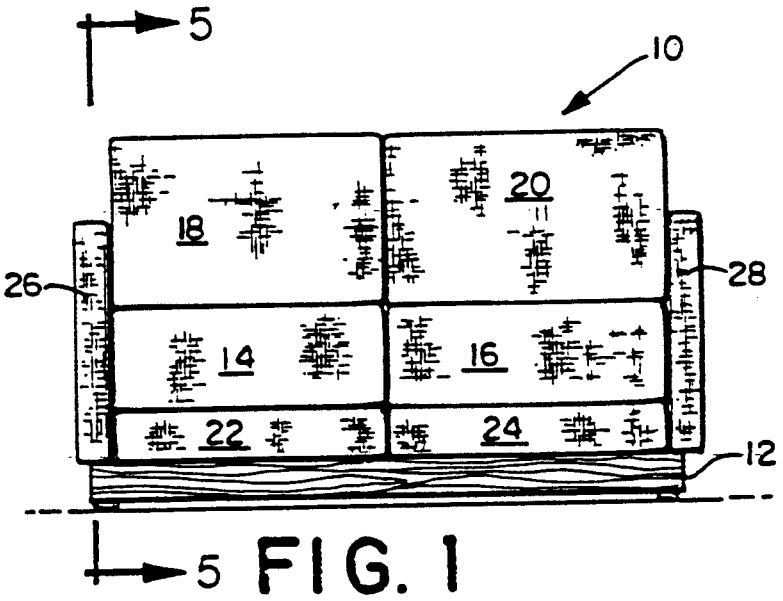
FIG. 1 is a diagrammatic front elevation view of an exemplary unit of the present invention.
Figure 2:
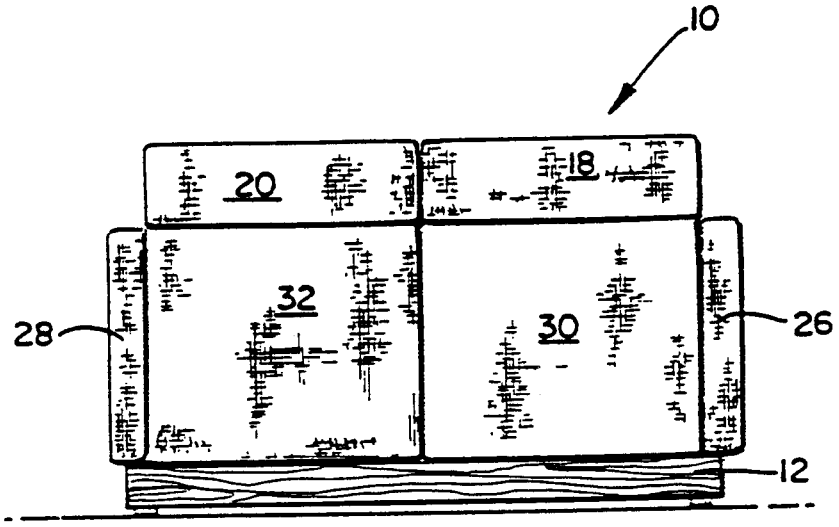
FIG. 2 is a diagrammatic rear elevation of the seating unit of FIG. 1.

Referring now to the drawings, in which like reference numerals identify like elements throughout the several views, there is shown in the various figures, a love seat unit 10 which exemplifies the present invention. The love seat unit 10 includes a frame 12, first and second upholstered seat cushions 14 and 16, respectively, first and second upholstered back cushions 18 and 20, respectively, first and second upholstered upright front panels 22 and 24, respectively, first and second upholstered upright side panels 26 and 28, respectively, and first and second upholstered upright back panels 30 and 32, respectively.

Preferably, each pair of first and second cushions 14 and 16, 18 and 20, respectively, is identical. Preferably, too, each pair of first and second front, side and back panels 22 and 24, 26 and 28, and 30 and 32, respectively, is also identical. Each of the cushions 14 through 20 and each of the panels 22 through 32 is perferably generally rectangular and upholstered on each of two opposing major sides and three of four narrow sides connecting the two major opposing sides. Preferably, the upholstery is in the form of a shaped, removable fabric cover the ends of which are secured on the fourth narrow side of each upholstered member which is hidden in use. The various seat cushions 14 through 20 and panels 22 through 32 collectively constitute the set of upholstered members of the love seat unit 10.

Figure 3:
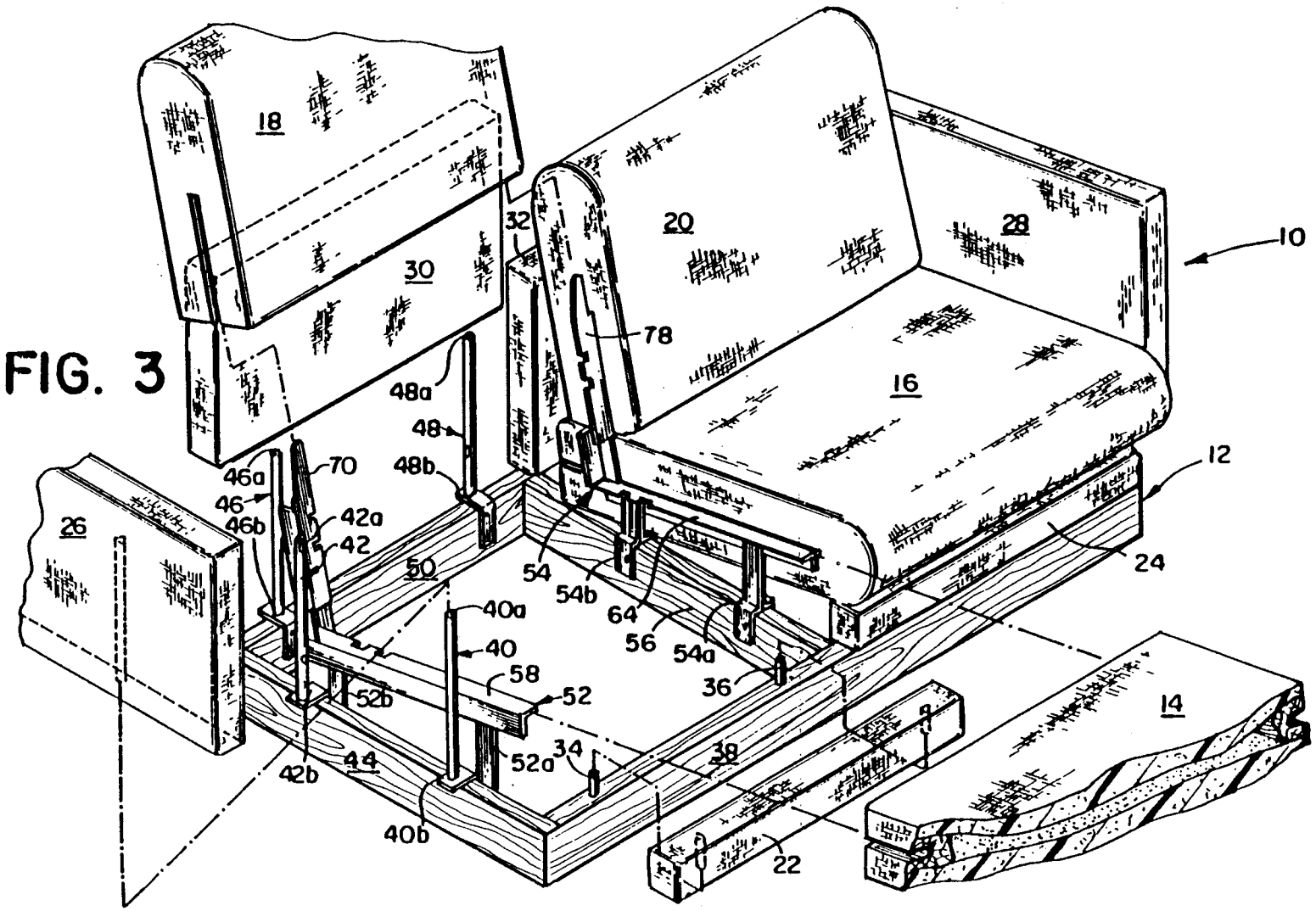
FIG. 3 is a diagrammatic perspective view of the seating unit of FIGS. 1 and 2 showing some of the removably secured members of that seating unit removed seating unit.

The first upholstered seat cushion 14, back cushion 18, front panel 22, side panel 26 and back panel 30 have been removed and spaced from the frame 12 in FIG. 3 to illustrate their mounting on the frame 12 by various support members coupled with the frame. The mounting of each of the second seat and back cushions and front, side and back panels 16, 20, 24, 28 and 32 is identical to that of the corresponding first upholstered member.

Preferably, a pair of support members 34 and 36 is located on a front side 38 of the frame 12 extending elongatedly upwardly for slidingly receiving the first upholstered upright front panel 22 and for being at least partially received in that panel. Preferably, a second pair of support members 40 and 42 is provided on a first lateral side 44 of the frame 12, extending elongatedly upwardly for slidingly receiving the first side panel 26 and for being at least partially received in that panel. Preferably too, another pair of support members 46 and 48 are provided on a rear side 50 of the frame 12 extending elongatedly upwardly for slidingly receiving the first back panel 30 and for being at least partially received in that panel.

A side rail 52 and a center rail 54 preferably are provided at the first lateral side 44 and center 56, respectively, of the frame 12. Preferably, the side and center rails 52 and 54 each include a generally horizontally disposed, elongatedly extending support member or "tongue" 58 and 64, respectively, for slidingly receiving the first seat cushion 14. Side and center rails 52 and 54 each also include a generally vertically disposed, elongatedly extending support member or "tongue" 70 and 78, respectively, for slidingly receiving the first back cushion 18. Preferably, the pair of tongues 58 and 70 of the side rail 52 are fixedly joined together at approximately a 90° angle and are rotated slightly so that the end of the horizontally disposed tongue 58, proximal the front side 38 of the frame 12 is higher than the end of that tongue 58 proximal to the rear side 50 of the frame 12 and similarly, the lower end of the vertically disposed tongue 70 is located forward of the upper end of that tongue 70 for increased seating comfort. The coupling of the support members 64 and 78 together and the orientation of those coupled members 64 and 78 of the center rail 54 mirror the support members 58 and 70 of the side rail 52. Each rail 52 and 54 is supported on the frame 12 by pairs of spaced, vertical mounting members 52*a*, 52*b* and 54*a*, 54*b*, respectively, each fixedly secured to one of the rails 52 and 54, respectively. Each of the mounting members 52*a*, 52*b* and 54*a*, 54*b* is fixedly secured to the frame by suitable means such as wood screws, or bolts and recessed threaded fasteners, neither of which are depicted.

Preferably, the side panel and back panel supporting members 40, 42, 46 and 48 are of similar construction. Preferably, each includes an elongated, hollow, generally tubular portion "a", fixedly joined by suitable means, such as weldments (not depicted), to a mounting bracket portion "b", such as a length of a angle iron. This mounting also enables the spacing of the tubular portion of each support member 40, 42, 46 and 48 laterally outwardly from the center of the first lateral side 44 and rear side 50, respectively, of the frame. This permits the use of larger diameter tubular portions "a", comparable or even greater in diameter than the thickness of the first lateral side 44 and rear side 50 portions of the frame 12, for increased strength and stability. This construction of the first lateral side support members 40 and 42 also helps to space at least the side panel 26 from the side rail 52 and the first seat and back cushions 14 and 18 supported on that rail 52. It further exposes the narrow bottom side of the side panel 26 for unlocking that panel 26, as will be described. The bracket portion "b" of each of the support members 40, 42, 46 and 48 is fixedly secured to the frame by suitable means (not depicted) such as wood screws where the frame 12 is made of wood. Preferably, the mounting bracket for this "b" support the tubular portions "a" to extend elongatedly and upwardly from the frame 12 for conveniently slidingly receiving the side and back panels 26 and 30, respectively, and for more firmly supporting those panels from the frame 12.

The rails 52 and 54 and other support members 34, 36, 40, 42, 46 and 48 thus removably support the upholstered members 14, 18, 22, 26 and 30, respectively, on the frame 12. The remaining upholstered members 16, 20, 24, 28 and 32 are identically supported on the frame.

Preferably, the rails 52 and 54 and each of the other support members 34, 36, 40, 42, 46 and 48 are made of steel or other metal for increased strength and durability.

Figure 4:
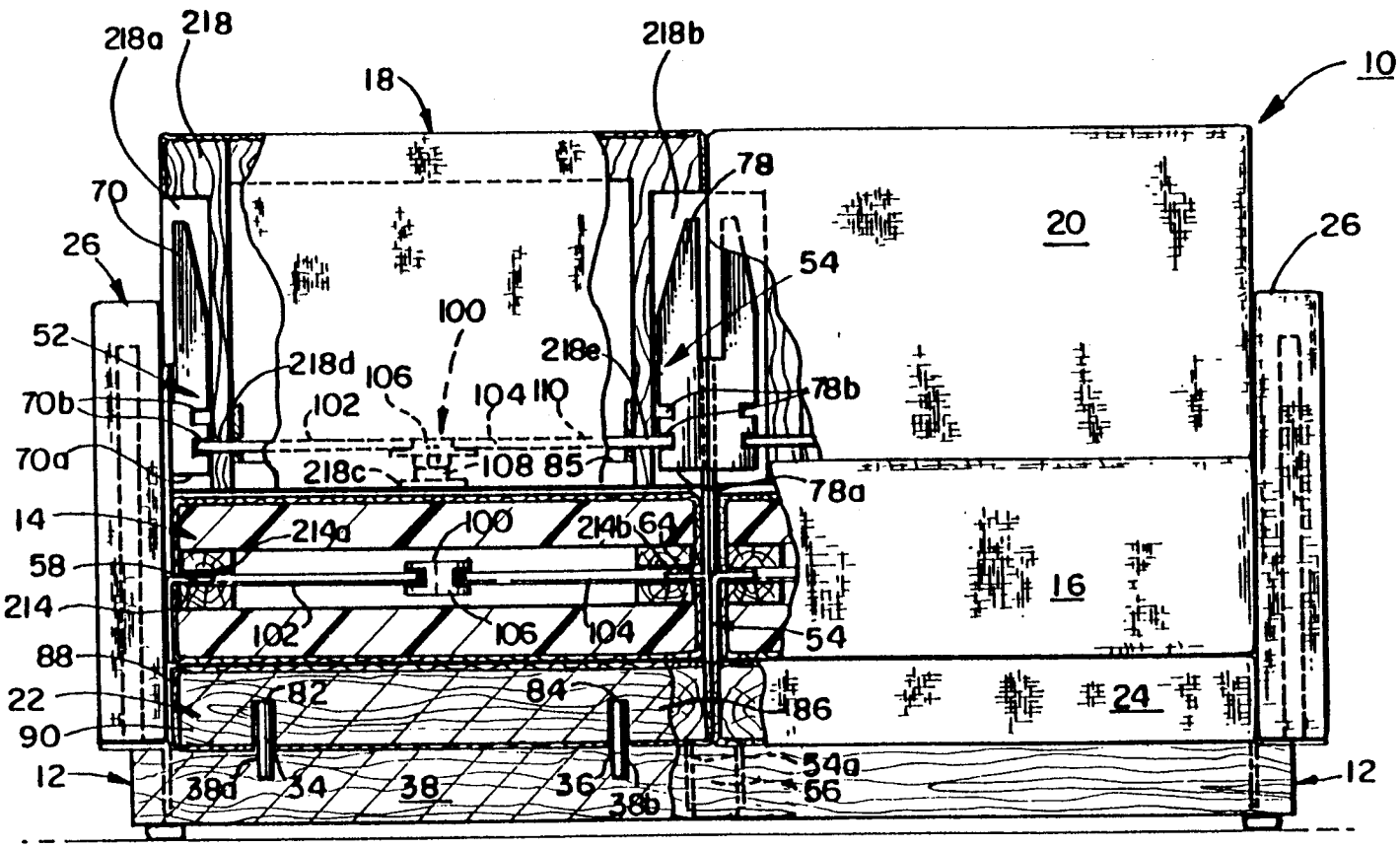
FIG. 4 is a diagrammatic front elevation of the seating unit of FIGS. 1 through 3 partially broken away at various locations for showing the mounting of the upholstered back and seat cushions and the upholstered front panel.

The front panel 22 and first seat and back cushions 14 and 18, respectively, are at least partially broken away in FIG. 4 to reveal their slide mounting on and receipt of at least part of support members 34, 36 and rails 52, 54, respectively. FIG. 4 reveals a preferred construction of the front panel 22 including a solid wood core 86 and a surrounding fabric cover 88. The cover 88 may be made removable from the core 86 by suitable shaping of the cover 88 and the provision of releasable fasteners (not depicted) such as snaps and VELCRO TM contact fasteners on the ends of the cover coming together on the narrow bottom side of the cover. The core 86 can be padding, if desired, for a softer appearance. Essentially all of the front panel support members 34 and 36 exposed above the frame 12 are slidingly received in the bores 82 and 84 in the core 86. The bores 82 and 84 are spaced inwardly equal distances from the lateral sides of the front panel 22, permitting the panel 22 to be rotatably mounted on the support members 34 and 36.

As is indicated in FIG. 4, the front panel support members 34 and 36 need only be lengths of rod which are connected with the frame 12 by being received in bores 38*a* and 38*b*, respectively. The bores 38*a* and 38*b* extend vertically into the front side 38 of the frame 12 to receive and support those rods extending elongatedly and upwardly from the frame 12 for slidingly receiving the front panel 22. In the disclosed preferred embodiment, the front panel 22 lies under and is protected by the seat cushion 14. Front panel 22 is not exposed so as to have to support the weight of an individual or other comparable loads. The rod-type support members 34 and 36 and bores 38*a* and 38*b* provide more than adequate support and are sufficient to secure the front panel to the frame 12 with the first seat cushion 14, even though the front panel support members 34 and 36 are not themselves fixedly secured to the frame 12.

Still referring to FIG. 4, the construction of the seat and back cushions 14 and 18 are substantially identical and, indeed, the cushions in fact, may be identical in all respects. However, it has been found for comfortable seating that the minimum acceptable length of the seat cushion 14 preferably exceeds the minimum acceptable length of the back cushion 18. Similarly, because seat cushion 14 typically supports more weight for longer periods of time than does the back cushion 18, the seat cushion 14 is configured to internally receive a greater length of its support members 58 and 64 than does the back cushion 18 of its support members 70 and 78, respectively. In all other respects the seat and back cushions 14 and 18 are substantially identical.

Specifically, each of the seat and back cushions 14 and 18 includes a generally rectangular hollow wooden frame 214 and 218, respectively. Frame 218 includes a pair of elongated slots 218*a* and 218*b*, respectively, extending from one end (the lower end) of the back cushion 18 along lateral sides of that cushion for slidably receiving substantially all of the support members 70 and 78, respectively. Similar though longer slots 214*a* and 214*b* are provided in the lateral sides of frame 214 of the seat cushion 14 for receiving that cushion's support members 58 and 64, respectively. This permits reversible mounting of each cushion 14 through 20.

Each of the first seat and back cushions 14 and 18, respectively, further includes an identical internal latch assembly 100. Each latch assembly 100 includes a pair of internal movable latch members 102 and 104, each preferably in the form of an elongated rod. Each of the latch members 102 and 104 is pivotally coupled at one end to a rectangular link member 106. The link member 106 is fixedly coupled to a rotatable actuator 108. Access to the actuator 108 is provided by an opening 218*c* (indicated in phantom) at the one end (lower end of the back cushion 18, rear end of seat cushion 14) which is hidden when that cushion 14 or 18 is mounted on its support members. Preferably, the actuator 108 is configured to receive a specially configured key which engages with the actuator and permits its rotation to withdraw the latch members 102 and 104 from slots 218*a* and 218*b* releasing back cushion 18 for removal or repositioning. Referring to back cushion 18, its latch members 102 and 104 extend through bores 218*d* and 218*e* passing through lateral sides of the internal wooden core 218 into the slots 218*a* and 218*b*, respectively, where the latch members 102 and 104 can contact the support members 70 and 78, respectively. The latch members 102 and 104 are biased to extend outwardly into the slots 218*a* and 218*b*, respectively, by biasing means in the form of a coil spring 110 having one end fixedly secured to the internal core 218 and another end fixedly joined with the latch member 104. Each of the support members 70 and 78 has structural means for receiving the respective latch members 102 and 104 to automatically and removably lock the back cushion 18 to the frame 12 through the fixedly secured support members 70 and 78 when the back cushion 18 is mounted thereon. In particular, each of the support members 70 and 78 is provided with a lower shoulder 70*a* and 78*a*, respectively, and a pair of cutouts 70*b* and 78*b*, respectively, for receipt of and interfering engagement with the latch members 102 and 104, respectively. Further details regarding the construction and operation of the cushions 14 and 18 and the support rails 52 and 54 and the construction and operation of the internal latch assembly 100 and its key are provided in U.S. Pat. 4,492,409, hereby incorporated by reference in its entirety.

As FIG. 3 illustrates, the second seat cushion 16 extends over and covers the upper side of the second front panel 24. The positioning of the first seat cushion 14 with respect to the first front panel 22 is identical. Similarly, the second back cushion 20 extends over and at least partially covers the upper side of the second back panel 32. The positioning of the first back cushion 18 with respect to the first back panel 30 is identical. Each seat cushion 14 and 16 sufficiently overlaps its adjoining front panel 22 and 24, respectively, to interfere with the movement of and to retain the respective front panel 22 and 24 on the support members receiving the front panels 22 and 24 when the seat cushions 14 and 16 are secured to their seat cushion receiving support members. Each back cushion 18 and 20 sufficiently overlaps its adjoining back panel 30 and 32, respectively, to interfere with the movement of and to retain the respective back panels 30 and 32 on the support members receiving the back panels 30 and 32 when the back cushions 18 and 20 are secured to their seat cushion receiving support members. In this way, the front panels 22, 24 and the back panels 30, 32 are automatically and removably secured to the frame 12 by interference between those panels, when mounted on their support members, and the seat and back cushions 14, 16 and 18, 20, respectively, mounted on and secured to their respective support members by the internal latch members.

Figure 5:
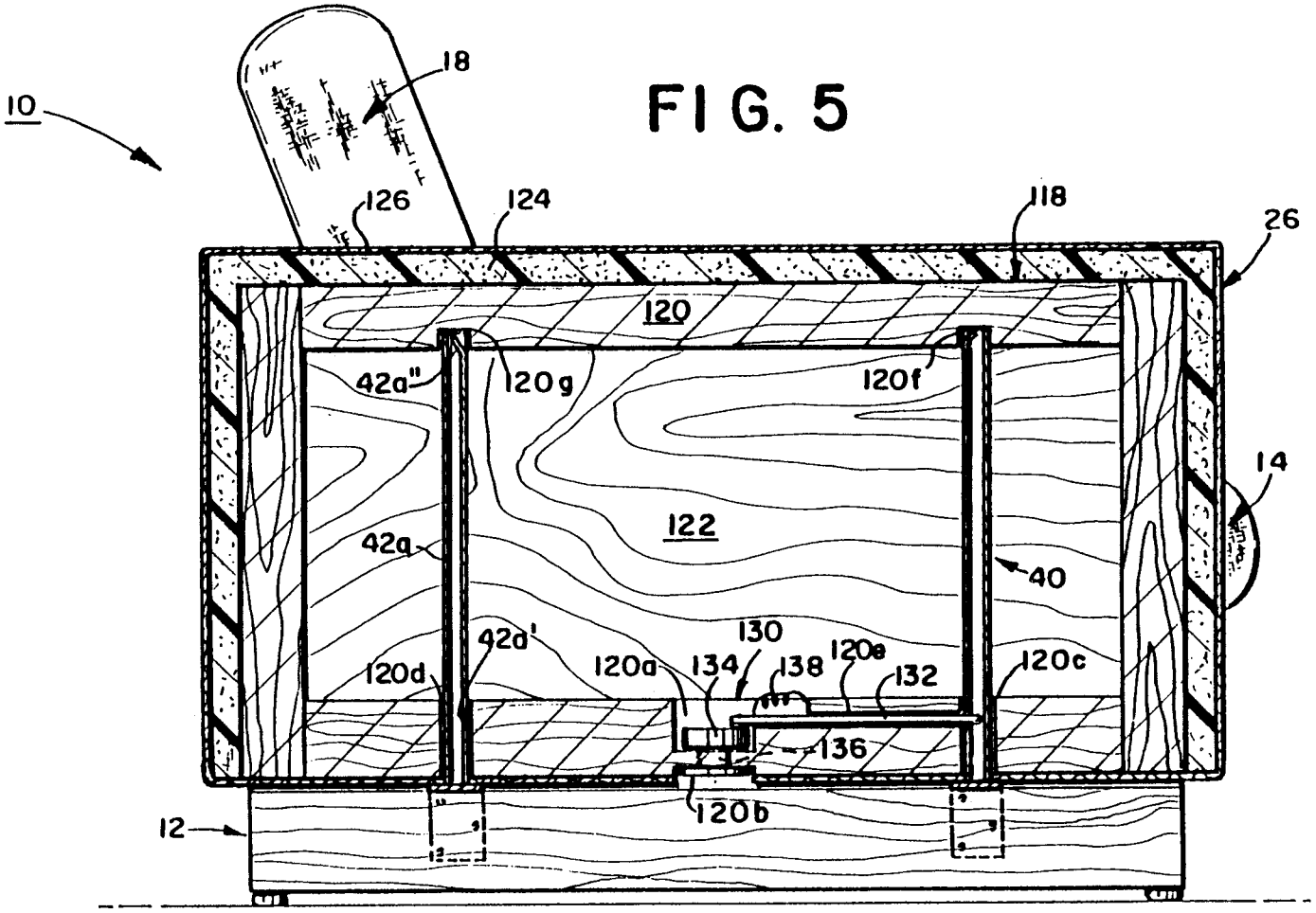
FIG. 5 is a diagrammatic cross-section taken along the lines 5—5 of FIG. 1 showing the mounting of an upholstered side panel.

FIG. 5 depicts diagrammatically the mounting of the first side panel 26 on its receiving support members 40 and 42, respectively. The preferred construction of the side panel 26 includes an internal frame 118 with a generally rectangular, hollow, wooden core 120, the two, open major sides of which are covered with wooden sheets, one of which is depicted at 122. A layer of padding 124 extends across both major sides and around the top and lateral narrow sides of the panel 26 and preferably is thickened along at least the top narrow side, in particular, to provide an integral arm rest. Fabric 126 is provided covering the padding 124. Preferably, the fabric 126 is configured in the form of a cover to slide over the upper and lateral narrow sides and the two major opposing sides of the internal frame 118 and the padding 124. The loose ends of the fabric 126 are preferably releasably secured together in some appropriate manner, again such as by the provision of mating snap fasteners or VELCRO TM contact fasteners (none depicted) on the loose ends of the fabric 126, along the bottom side of side panel 26 which is normally hidden from view.

The side panel 26 includes an internal latch assembly 130 mounted in a partially hollowed out area 120*a* of the core 120. The internal latch assembly 130 preferably includes a single, movable latch member 132, again such as an elongated rod, having one end pivotally coupled to a link member 134. The link member 134 is fixedly coupled with a rotatable actuator 136 exposed through an opening 120*b* provided in the bottom narrow side of the core 120. The rotatable actuator 136 is again preferably configured to accept a specially configured key (not depicted) which engages with and permits the rotation of the rotatable actuator 136 and lateral movement of the latch member 132. A pair of vertical bores 120*c* and 120*d* are provided at appropriate spacing to slidingly receive the support members 40 and 42, respectively, extending upwardly from the frame 12. The remaining, free end of the latch member 132 is passed through a third bore 120*e* which extends laterally from the hollowed-out area 120*a* into the one vertical bore 120*c*. Again, biasing means in the form of a coil spring 138 is connected between the latch member 132 and a portion of the core 120 and biases the latch member 132 into the bore 120*c* thereby assuring automatic contact with the support member 40 received therein. Preferably, the tubular portions of support members 40 and 42 mirror one another for releasable locking engagement of either support member 40 and 42 with the latch member 132. In particular, referring to support member 42, the tubular portion 42*a* is provided with a lateral bore 42*a'* at an appropriate height to receive the latch member 132 when the side panel 26 is resting upon the support members 40 and 42. Also, preferably, a tab portion 42*a*" is cut from the upper end of the tubular member 42*a* on a side facing the other support member 40 and is deflected inwardly to the opposite side of that tubular member 42*a*, away from support member 40, to form a beveled cam surface. That cam surface is contacted by the latch member 132 when the side panel 26 is initially slidingly received on the support members 40 and 42, respectively, to move the latch member 132 inwardly against the bias of spring 138. By locating the bores 120*c* and 120*d* at equal distances in from the lateral side edges of the internal frame 118 and along a central plane of the side panel 26, which is substantially identical to the plane of FIG. 5, the side cushion 26 can not only be reversed from its existing position on one side (the left side as viewed in FIG. 1) of the love seat to the opposing side (right side as viewed in FIG. 1), but also reversibly mounted on the same receiving support member 40 and 42 to expose either of its two upholstered major sides. Preferably, upper recesses 120*f* and 120*g* are provided in the upper part of the internal frame 120 to receive the upper ends of the support members 40 and 42 to provide added stability on the upper end of the side panel 26.

In the preferred embodiment, the construction of the back panels 30 and 32 (not shown in detail) is substantially identical to the construction of the side panel 26, depicted in FIG. 5, with the exception that the internal latch assembly 130 and the hollow 120*a* and latch related bores 120*b* and 120*e* provided in the side panel 26 are omitted. Bores like bores 120*c*, 120*d*, 120*f* and 120*g* are provided in the internal frame of the back panels 30 and 32, spaced equal distances from the lateral sides of those panels 30 and 32, to receive their respective support members. This construction makes the back panels 30 and 32 exchangeable with one another and reversibly mountable to the receiving pair of support members 46 and 48 and to an identical set of support members (not depicted) receiving and supporting the second back panel 32 in the various figures.

Though not specifically described or depicted, one of ordinary skill in the art will appreciate that a chair, i.e. an individual seating unit, could be provided by using a single set of the back and seat cushions and the front and back panels between a pair of identical side panels 26 and 28. In that type of furniture piece, center rail 54 would be eliminated and a second side rail, mirroring side rail 52, would be employed on an opposite side of a shortened frame. Similarly, frame 12 can be widened to receive one or more pairs of central rails and additional sets of seat and back cushions and front and rear panels to build a sofa or other such furniture having three or more seats.

Although presently not preferred, one of ordinary skill in the art will appreciate that the side panels and the back panels can, if desired, be identically sized so as to be interchangeable with one another. Furthermore, the rails supporting the seat cushions 14 and 16 and back cushions 18 and 20 can be adjusted so that back panels 30 and 32 are not trapped by the back cushions 18 and 20. In such a construction, back panels with internal latch assemblies, like latch assembly 130, and support members with latch engagement structures those like members 40 and 42 are provided for automatically and releasably locking such back panels to the frame 12. Other combinations of self-locking, latch equipped and latchless, trapped panels and cushions will occur to those of ordinary skill in this art.

Also, although not presently preferred, one central support member or even three or more support members can be provided and used with any upholstered member in place of the pairs of support members preferably provided for each upholstered member, if desired and if the upholstered member is suitably modified.

Thus, the invention provides fully upholstered seating units, the individual upholstered members of which are ordinarily secured to the frame of the unit to prevent loss, and are easily and readily removed for cleaning, repair or replacement merely by insertion and partial rotation of a key into those members or into other overhanging upholstered member(s) trapping that member. Furthermore, the upholstered members of the disclosed seating units are reversible, not only side-to-side on the unit but also at each individual mounting location of that upholstered member on the seating unit. Also, the disclosed seating units are modular. The same basic upholstered members can be used to fabricate a seating unit of any desired seating capacity which provides all the benefits and versatility of the disclosed love seat 10.

It will be recognized by those of ordinary skill in the art that numerous changes may be made to the disclosed embodiment of the invention in addition to those already suggested without departing from the broad concept of the invention. Accordingly, reference should be made to the appended claims, rather than to the foregoing description, as indicating the scope of the invention.

I claim:

1. An upholstered seating unit comprising:

a frame;

a plurality of upholstered members including at least a back cushion, a seat cushion and a panel;

a plurality of support members fixedly secured to the frame, each support member extending from the frame for slidingly receiving one of the upholstered members and each of the upholstered members internally receiving at least part of one of the support members, the support members removably supporting the upholstered members on the frame, the back and seat cushions forming at least part of an exposed upper portion of the seating unit and the one panel forming part of an exposed side portion of the seating unit, the one panel extending alongside at least one of the seat and back cushions, each of the upholstered members having two opposing, upholstered, major sides and being configured with respect to the support member receiving that upholstered member for reversible mounting on the support member to expose either upholstered major side;

an internal, biased, movable latch member in each of the upholstered members;

structural means on each support member for receiving the latch member to automatically and removably lock the upholstered members to the frame through the support members; and an additional upholstered member lacking an internal latch member and an additional support member extending from the frame, the additional upholstered member being slidingly received on and internally receiving part of the additional support member, the additional upholstered member being removably secured to the frame by interference with one of the plurality of upholstered members when the one upholstered member is secured to one of the plurality of support members.

2. The seating unit of claim 1 wherein each of the upholstered members is configured for reversible mounting on the receiving support member.

3. The upholstered seating unit of claim 1 wherein the additional upholstered member is a back panel and the additional support member extends upwardly from a rear side of the frame; and wherein the back cushion sufficiently overlaps the back panel to retain the back panel on the rear side support member when the back cushion is secured to the support member receiving the back cushion.

4. The upholstered seating unit of claim 3 comprising a plurality of identical upholstered seat cushions, an equal plurality of identical upholstered back cushions, and an equal plurality of identical upholstered back panels all removably attached to the frame by support members.

5. The upholstered seating unit of claim 1 wherein the additional upholstered member is a front panel and the additional support member extends upwardly from a front side of the frame; and wherein the seat cushion sufficiently overlaps the front panel to retain the front panel on the front side support member when the seat cushion is secured to the support member receiving the seat cushion.

6. The upholstered seating unit of claim 5 comprising a plurality of identical upholstered seat cushions, an equal plurality of identical upholstered back cushions, and an equal plurality of upholstered front panels all removably attached to the frame by support members.

7. The upholstered seating unit of claim 1 wherein the one panel is a side panel of the seating unit.

8. The upholstered seating unit of claim 7 wherein the support member of the side panel is located outwardly from the back for exposing a bottom side of the side panel while supporting the side panel and further comprising an opening through the bottom side of the side panel providing access for unlocking the side panel from the side panel support member.

9. An upholstered seating unit comprising:

a frame;

a plurality of upholstered members including at least a back cushion, a seat cushion and a panel;

a plurality of support members connected with the frame, each of the support members extending from the frame for slidingly receiving one of the upholstered members and each of the upholstered members internally receiving at least part or one of the support members for removably supporting the upholstered members on the frame by the support members the back and seat cushions forming at least part of an exposed upper portion of the seating unit and the one panel forming part of an exposed side portion of the seating unit, the one panel extending alongside at least one of the seat and back cushions, each of the upholstered members having two opposing, upholstered, major sides and being configured with respect to the support member receiving that upholstered member for reversible mounting on the support member to expose either upholstered major side; and an internal, biased, movable latch member in each of a subset of the plurality of upholstered members and each of the remaining upholstered members of the plurality lacking a latch;

each support member receiving one of the upholstered members of the subset being fixedly secured to the frame and having structural means for receiving the latch member to automatically and removably lock the subset of upholstered members to the frame through the support members, and the subset of locked, upholstered members interfering with movement of each of the remaining upholstered members on the support members receiving the remaining upholstered members for preventing removal of the remaining upholstered members from the support members and the frame whereby all upholstered members of the seating unit are automatically and removably secured to the frame.

10. The upholstered seating unit of claim 9 wherein the plurality of upholstered members includes at least two identical side panels a rear panel and a front panel.

* * * * *